US011592769B1

(12) United States Patent
Kodera et al.

(10) Patent No.: US 11,592,769 B1
(45) Date of Patent: Feb. 28, 2023

(54) FIXATION DEVICE AND IMAGE FORMING APPARATUS

(71) Applicant: FUJIFILM Business Innovation Corp., Tokyo (JP)

(72) Inventors: Tetsuro Kodera, Kanagawa (JP); Kosuke Yamada, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/541,685

(22) Filed: Dec. 3, 2021

(30) Foreign Application Priority Data

Aug. 25, 2021 (JP) ..... JP2021-137604

(51) Int. Cl.
*G03G 15/20* (2006.01)

(52) U.S. Cl.
CPC ..... *G03G 15/2028* (2013.01); *G03G 15/2032* (2013.01); *G03G 15/2064* (2013.01); *G03G 2215/2058* (2013.01)

(58) Field of Classification Search
CPC ..... G03G 2215/2058; G03G 15/2064; G03G 15/2032; G03G 15/2028
See application file for complete search history.

(56) References Cited

U.S. PATENT DOCUMENTS

2002/0025204 A1* 2/2002 Ando ..... G03G 15/2028 358/1.12
2015/0205234 A1* 7/2015 Takahashi ..... G03G 15/2028 399/323

FOREIGN PATENT DOCUMENTS

CN 101995799 B * 7/2013 ..... G03G 15/2028
CN 107436550 A * 12/2017 ..... G03G 15/234
JP H05-330225 A 12/1993
JP 2011197133 A * 10/2011 ..... B65H 5/36

* cited by examiner

*Primary Examiner* — Sevan A Aydin
(74) *Attorney, Agent, or Firm* — Oliff PLC

(57) ABSTRACT

A fixation device includes: a heating roll that heats a transported recording medium whose front end is gripped by a gripping part while rotating; a pressing roll that is disposed so as to face the heating roll, around which at least a part of the transported recording medium is wound, and presses the wound part of the recording medium toward the heating roll while rotating; a peeling part that peels the recording medium off from the pressing roll by lifting the front end of the recording medium up in a state where the front end of the recording medium has passed a portion where the pressing roll and the heating roll face each other and is no longer gripped by the gripping part; and a reducing part that reduces momentum of the peeling part lifting the front end of the recording medium up.

19 Claims, 14 Drawing Sheets

FIXATION DEVICE AND IMAGE FORMING APPARATUS

CROSS-REFERENCE TO RELATED APPLICATIONS

This application is based on and claims priority under 35 USC 119 from Japanese Patent Application No. 2021-137604 filed Aug. 25, 2021.

BACKGROUND

(i) Technical Field

The present disclosure relates to a fixation device and an image forming apparatus.

(ii) Related Art

The screen printer described in Japanese Unexamined Patent Application Publication No. 05-330225 has a perforated cylindrical plate cylinder 1 having perforated stencil paper wound therearound, a clamper provided on an outer circumferential surface of the plate cylinder at a predetermined position and holding a front end part of the stencil paper in an openable and closable manner, and a pressure cylinder brought into contact with the plate cylinder with paper interposed therebetween and rotated when the paper is supplied between the pressure cylinder and the plate cylinder and having a recessed part for avoiding interference of the clamper and provided so as to be freely brought into contact with or separate from the plate cylinder, and has a push-out unit for floating the front end part of the printed paper from the outer circumferential surface of the pressure cylinder at one end part of the recessed part.

SUMMARY

Some fixation devices hold a recording medium between a rotating pressing roll and a heating roll. In some cases, a recording medium transported while a front end thereof is being gripped by a gripping part is wound around the rotating pressing roll. In such a configuration, the heating roll heats the recording medium by making contact with a part of the recording medium wound around the pressing roll. Furthermore, a peeling part peels the recording medium heated by the heating roll off from the pressing roll. Specifically, the peeling part peels the recording medium off from the pressing roll by lifting the front end of the recording medium up from the pressing roll.

However, momentum of the peeling part lifting the front end of the recording medium up from the pressing roll may undesirably cause the recording medium to be wound around the heating roll.

Aspects of non-limiting embodiments of the present disclosure relate to making it less likely that a recording medium is wound around a heating roll than in a case where a peeling part lifts a front end of a recording medium up without reducing momentum.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a fixation device including: a heating roll that heats a transported recording medium whose front end is gripped by a gripping part while rotating; a pressing roll that is disposed so as to face the heating roll, around which at least a part of the transported recording medium is wound, and presses the wound part of the recording medium toward the heating roll while rotating; a peeling part that peels the recording medium off from the pressing roll by lifting the front end of the recording medium up in a state where the front end of the recording medium has passed a portion where the pressing roll and the heating roll face each other and is no longer gripped by the gripping part; and a reducing part that reduces momentum of the peeling part lifting the front end of the recording medium up.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
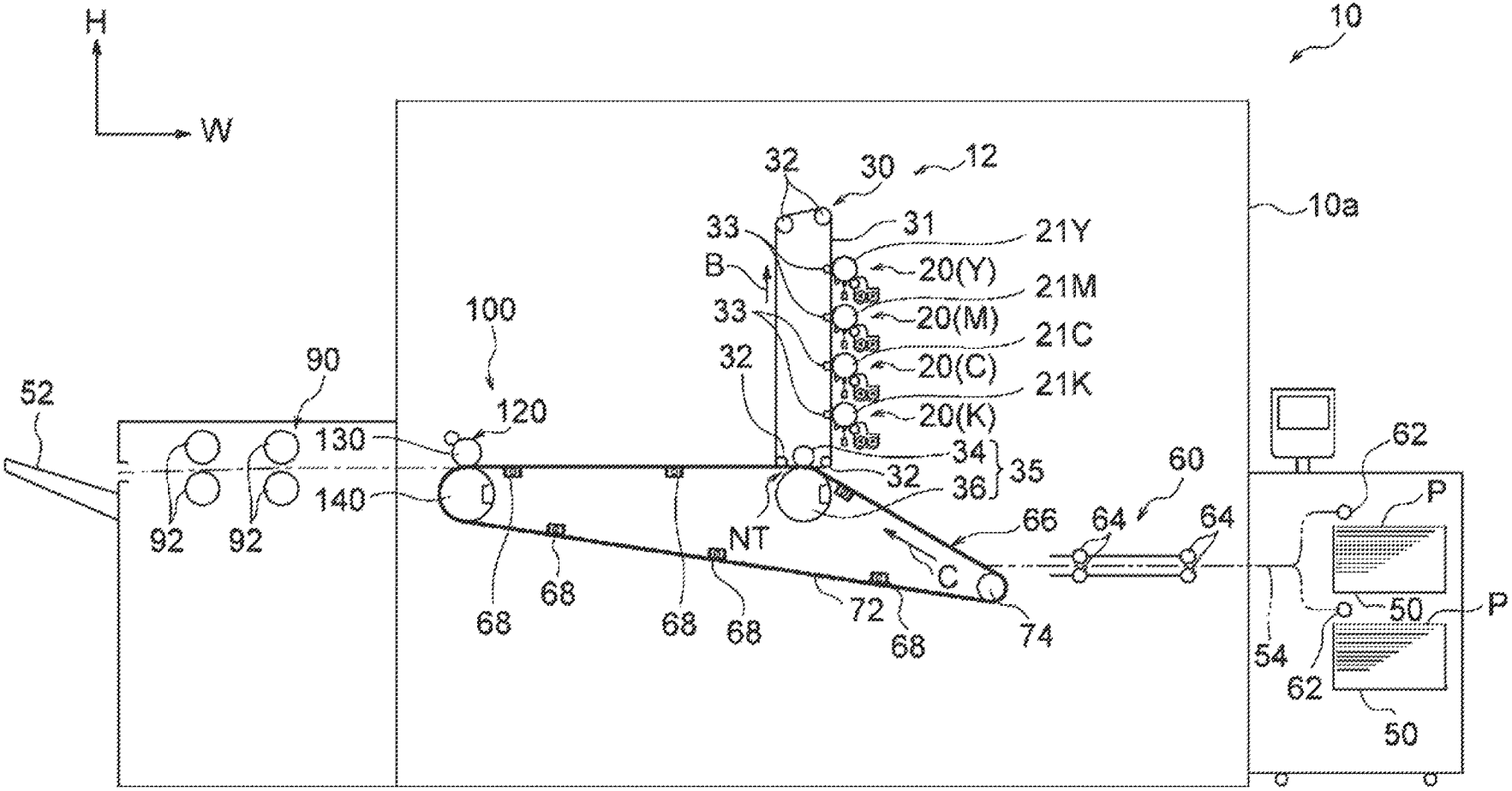
FIG. 1 is a schematic configuration diagram illustrating an image forming apparatus according to a first exemplary embodiment of the present disclosure.

An example of a fixation unit and an image forming apparatus according to a first exemplary embodiment of the present disclosure is described with reference to FIGS. 1 to 13. In the drawings, arrow H indicates an apparatus top-bottom direction (vertical direction), arrow W indicates an apparatus width direction (horizontal direction), and arrow D indicates an apparatus depth direction (horizontal direction). The apparatus width direction and the apparatus depth direction are orthogonal to each other.

Image Forming Apparatus 10

As illustrated in FIG. 1, the image forming apparatus 10 is an electrophotographic image forming apparatus that forms a toner image on a sheet member P, which is an example of a recording medium. The image forming apparatus 10 includes storages 50, a discharge part 52, an image forming part 12, a transport mechanism 60, a fixation part 100, and a cooling part 90.

Storage 50, Discharge Part 52

As illustrated in FIG. 1, the storages 50 are disposed on one side of an apparatus body 10*a* in the apparatus width direction and is drawable from the apparatus body 10*a*. Specifically, two storages 50 are arranged in the apparatus top-bottom direction. Sheet members P of different sizes are stored in the respective storages 50.

The discharge part 52 is disposed on the other side of the apparatus body 10*a* in the apparatus width direction. A sheet member P on which a toner image has been formed is discharged to the discharge part 52.

Cooling Part 90

As illustrated in FIG. 1, the cooling part 90 is disposed on the one side relative to the discharge part 52 in the apparatus width direction and includes a pair of cooling rolls 92 arranged in the apparatus width direction. The cooling rolls 92 are cylindrical rolls made of a material such as a metal. Air passes through the cooling rolls 92.

In this configuration, the cooling part 90 cools a sheet member P heated by the fixation part 100 through heat exchange with passing air. Furthermore, the cooling part 90 discharges the cooled sheet member to the discharge part 52.

Image Forming Part 12

As illustrated in FIG. 1, the image forming part 12 is disposed between the storages 50 and the cooling part 90 in the apparatus width direction. The image forming part 12 includes toner image forming parts 20 that form toner images and a transfer device 30 that transfers toner images formed by the toner image forming parts 20 onto a sheet member P.

Toner Image Forming Parts 20

The toner image forming parts 20 are provided for formation of toner images of respective colors. The image forming apparatus 10 includes toner image forming parts 20 for four colors: yellow (Y), magenta (M), cyan (C), and black (K).

The toner image forming parts 20 for the four colors are arranged in an order of yellow (Y), magenta (M), cyan (C), and black (K) from an upstream side from an upper side toward a lower side in a circling direction (direction indicated by arrow B in FIG. 1) of a transfer belt 31 (details will be described later).

Figure 2:
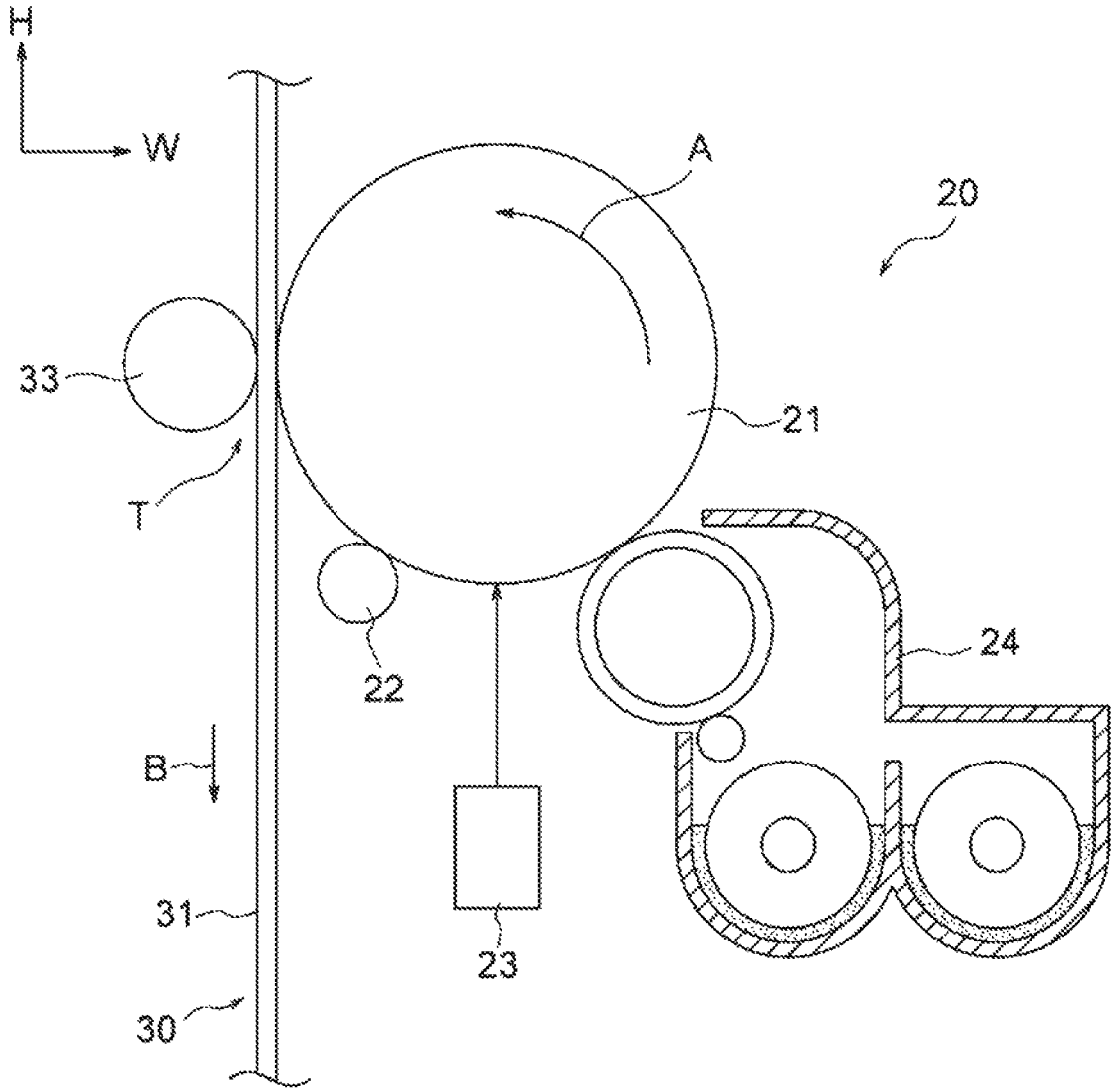
FIG. 2 is a configuration diagram illustrating a toner image forming part provided in the image forming apparatus according to the first exemplary embodiment of the present disclosure.

The toner image forming parts 20 for the respective colors basically have a similar configuration except for used toner. Specifically, as illustrated in FIG. 2, each of the toner image forming parts 20 for the respective colors includes an image carrier 21 (photoreceptor) that rotates in a direction indicated by arrow A in FIG. 2 and a charging unit 22 that charges the image carrier 21. Furthermore, each of the toner image forming parts 20 for the respective colors includes an exposure device 23 that forms an electrostatic latent image on the image carrier 21 by exposing the image carrier 21 charged by the charging unit 22 to light and a developing device 24 that forms a toner image by developing the electrostatic latent image formed on the image carrier 21 by the exposure device 23.

In this configuration, the toner image forming parts 20 for the respective colors form toner images of the respective colors by using toner of the respective colors.

Transfer Device 30

As illustrated in FIG. 1, the transfer device 30 includes the transfer belt 31, which is an intermediate transfer body, first transfer rolls 33, and a transfer part 35.

Transfer Belt 31

As illustrated in FIG. 1, the transfer belt 31 is an endless belt that is suspended around plural rolls 32 and extends in the apparatus top-bottom direction, and is in contact with the image carriers 21 of the respective colors. The transfer belt 31 is caused to circle in the direction indicated by arrow B in FIG. 1 by rotary driving of at least one of the plural rolls 32.

First Transfer Rolls 33

As illustrated in FIG. 1, the first transfer rolls 33 are disposed on sides opposite to the image carriers 21 of the respective colors with the transfer belt 31 interposed therebetween, respectively. As illustrated in FIG. 2, each of the first transfer rolls 33 transfers a toner image formed on corresponding one of the image carriers 21 onto the transfer belt 31 at a first transfer position T between the corresponding image carrier 21 and the first transfer roll 33.

Transfer Unit 35

As illustrated in FIG. 1, the transfer part 35 is disposed in a lower side portion of the transfer belt 31 and includes a secondary transfer roll 34 and an opposed roll 36. The opposed roll 36 is disposed on a lower side of the transfer belt 31 so as to face the transfer belt 31 in the apparatus top-bottom direction. The secondary transfer roll 34 is disposed on a side opposite to the opposed roll 36 with the transfer belt 31 interposed therebetween.

In this configuration, each of the first transfer rolls 33 transfers a toner image formed on the corresponding image carrier 21 onto the transfer belt 31 at the first transfer position T. Furthermore, the transfer belt 31 circles to transport the toner image transferred by the first transfer to a secondary transfer position NT. Furthermore, the transfer part 35 transfers the toner image transferred onto the transfer belt 31 onto a sheet member P passing the secondary transfer position NT by electrostatic force generated by the secondary transfer roll 34.

Transport Mechanism 60

As illustrated in FIG. 1, the transport mechanism 60 is disposed on a lower side of the image forming part 12 in the apparatus top-bottom direction. The transport mechanism 60 includes feeding rolls 62, transport rolls 64, and a chain gripper 66.

Feeding Rolls 62, Transport Rolls 64

The feeding rolls 62 are disposed in contact with front end portions of sheet members P stored the storages 50 so as to feed the sheet members P stored in the storages 50. Each of the feeding rolls 62 is configured to feed a sheet member P to a transport path 54 along which the sheet member P is transported.

The transport rolls 64 are arranged side by side in the apparatus width direction on a downstream side relative to the feeding rolls 62 in a direction in which the sheet member P is transported. The transport rolls 64 receive a sheet member P fed to the transport path 54 by the feeding rolls 62 and transport the received sheet member P toward the chain gripper 66.

Chain Gripper 66

Figure 3:
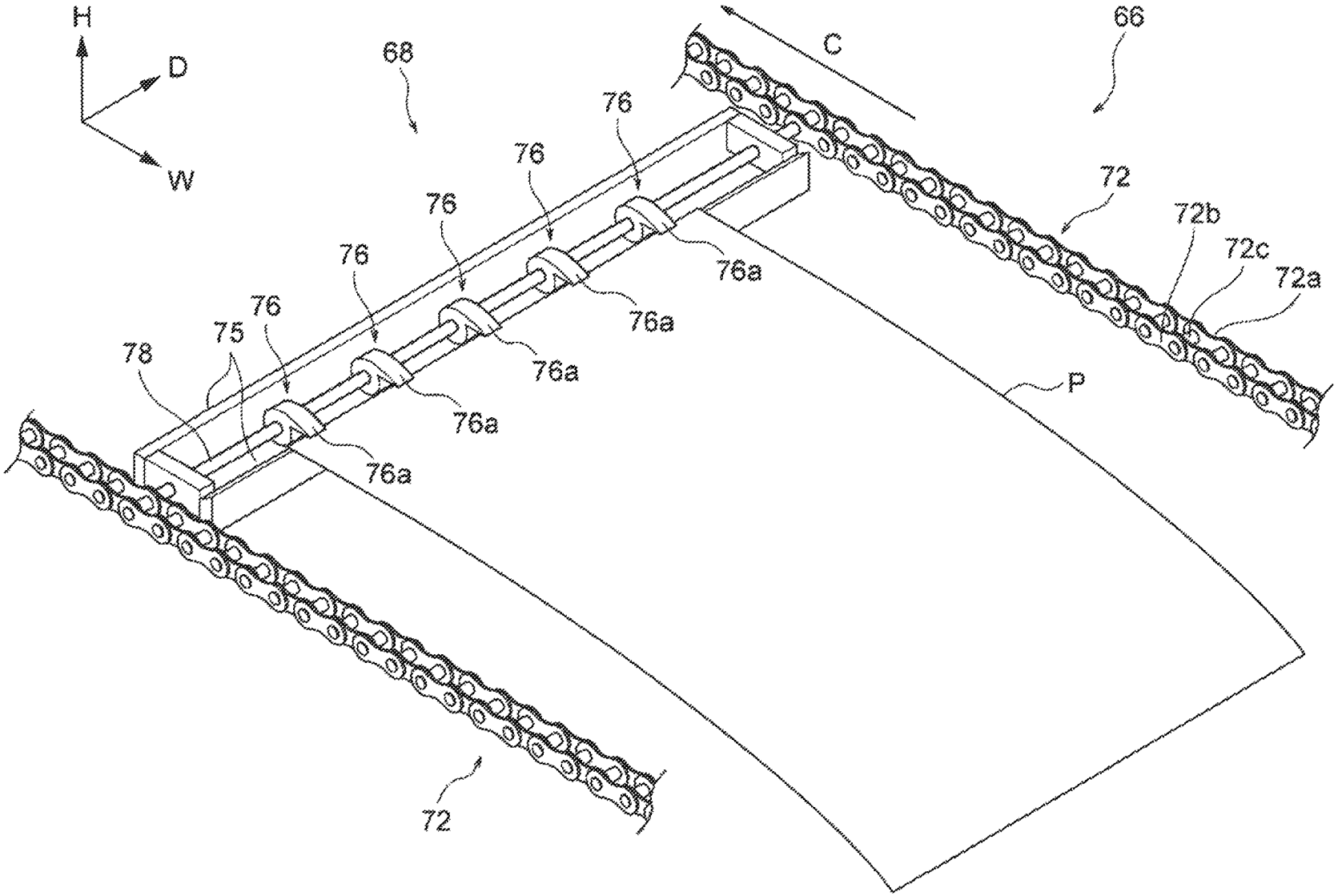
FIG. 3 is a perspective view illustrating a chain gripper provided in the image forming apparatus according to the first exemplary embodiment of the present disclosure.
Figure 4:
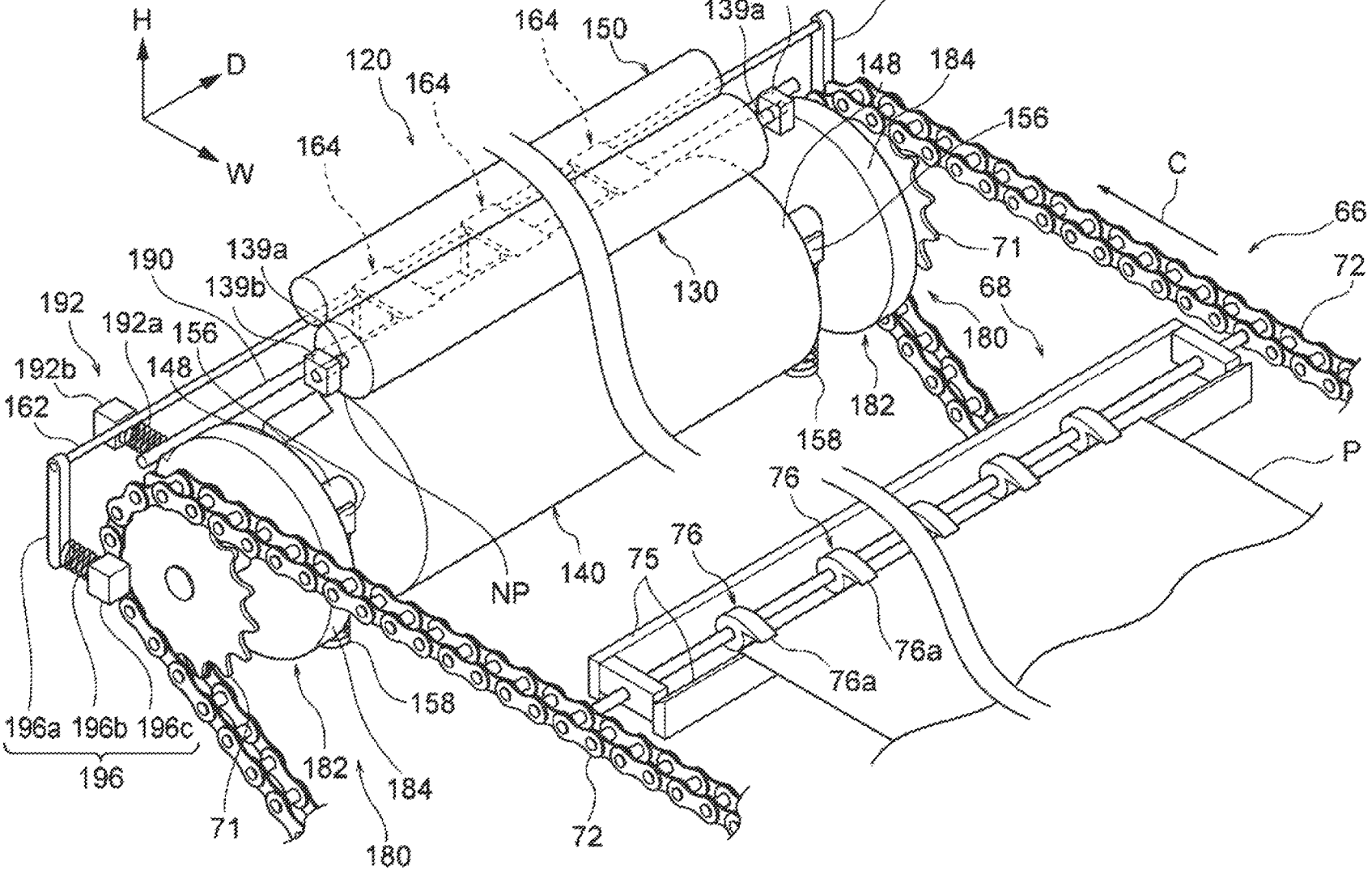
FIG. 4 is a perspective view illustrating members such as a fixation unit provided in the image forming apparatus according to the first exemplary embodiment of the present disclosure.

The chain gripper 66 is disposed on the other side relative to the transport roll 64 in the apparatus width direction. As illustrated in FIGS. 3 and 4, the chain gripper 66 includes a pair of chains 72 and gripping parts 68.

Chain 72

The pair of chains 72 are provided apart from each other in the apparatus depth direction, as illustrated in FIG. 3. Furthermore, each of the chains 72 is an endless chain and includes plural outer plates 72*a* made of a metal, plural inner plates 72*b* made of a metal, and pins 72*c* that connect the outer plates 72*a* and the inner plates 72*b*. The pair of chains 72 illustrated in FIG. 1 are suspended around a pair of sprockets (not illustrated) disposed on both end sides of the opposed roll 36, a pair of sprockets 71 (see FIG. 4) disposed on both end sides of a pressing roll 140, which will be described later, and a pair of sprockets 74 disposed apart from each other in the apparatus depth direction.

Specifically, as illustrated in FIG. 1, the pressing roll 140 provided with the sprockets 71 on both end sides thereof is disposed on the other side relative to the opposed roll 36 in the apparatus width direction. Furthermore, the pair of sprockets 74 are disposed on one side relative to the opposed roll 36 in the apparatus width direction and on a lower side relative to the opposed roll 36 in the apparatus top-bottom direction. The pair of chains 72 are suspended around these sprockets. When any of the pair of sprockets rotates, the chains 72 circle in a direction indicated by arrow C.

Gripping Part 68

The gripping parts 68 are disposed at predetermined intervals along a circumferential direction of the chains 72, as illustrated in FIG. 1. As illustrated in FIG. 3, each of the gripping parts 68 includes an attachment member 75 whose both ends are attached to the pair of chains 72, respectively and extends in the apparatus depth direction and grippers 76 attached to a shaft member 78 attached to the attachment member 75 and extending in the apparatus depth direction.

Figure 5:
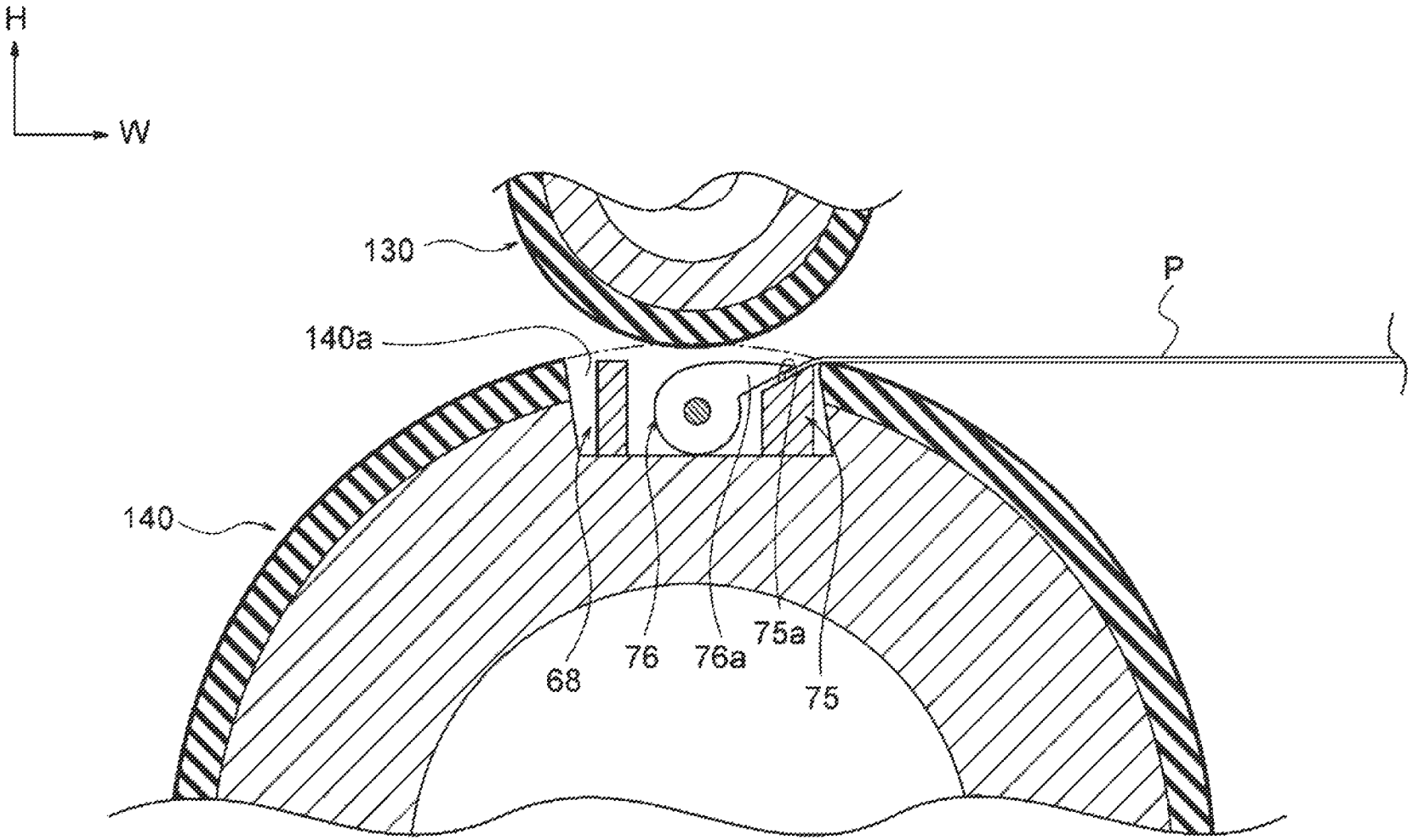
FIG. 5 is a cross-sectional view illustrating members such as a fixation unit provided in the image forming apparatus according to the first exemplary embodiment of the present disclosure.

The grippers 76 are attached to the shaft member 78 at predetermined intervals along the apparatus depth direction. The grippers 76 is configured to grip a front end of a sheet member P. Specifically, each of the grippers 76 has a claw 76*a*. As illustrated in FIG. 5, the attachment member 75 has a contact surface 75*a* with which the claw 76*a* makes contact. Each of the grippers 76 grips a sheet member P by holding a front end of the sheet member P between the claw 76*a* and the contact surface 75*a*. Each of the grippers 76 is, for example, configured such that the claw 76*a* is pressed against the contact surface 75*a* by a spring or the like and the claw 76*a* is separated away from the contact surface 75*a* due to action of a cum or the like.

In this configuration, in the chain gripper 66, the grippers 76 of the gripping part 68 receive a sheet member P transported by the transport rolls 64 and grip a front end of the sheet member P. Furthermore, the chains 72 circle, and thereby the gripping part 68 transports the sheet member P whose front end has been gripped to the secondary transfer position NT. Furthermore, the gripping part 68 transports the sheet member P to a fixation unit 120.

Fixation Part 100

As illustrated in FIG. 1, the fixation part 100 is disposed on a downstream side relative to the secondary transfer position NT in the direction in which the sheet member P is transported.

Fixation Unit 120

Figure 6:
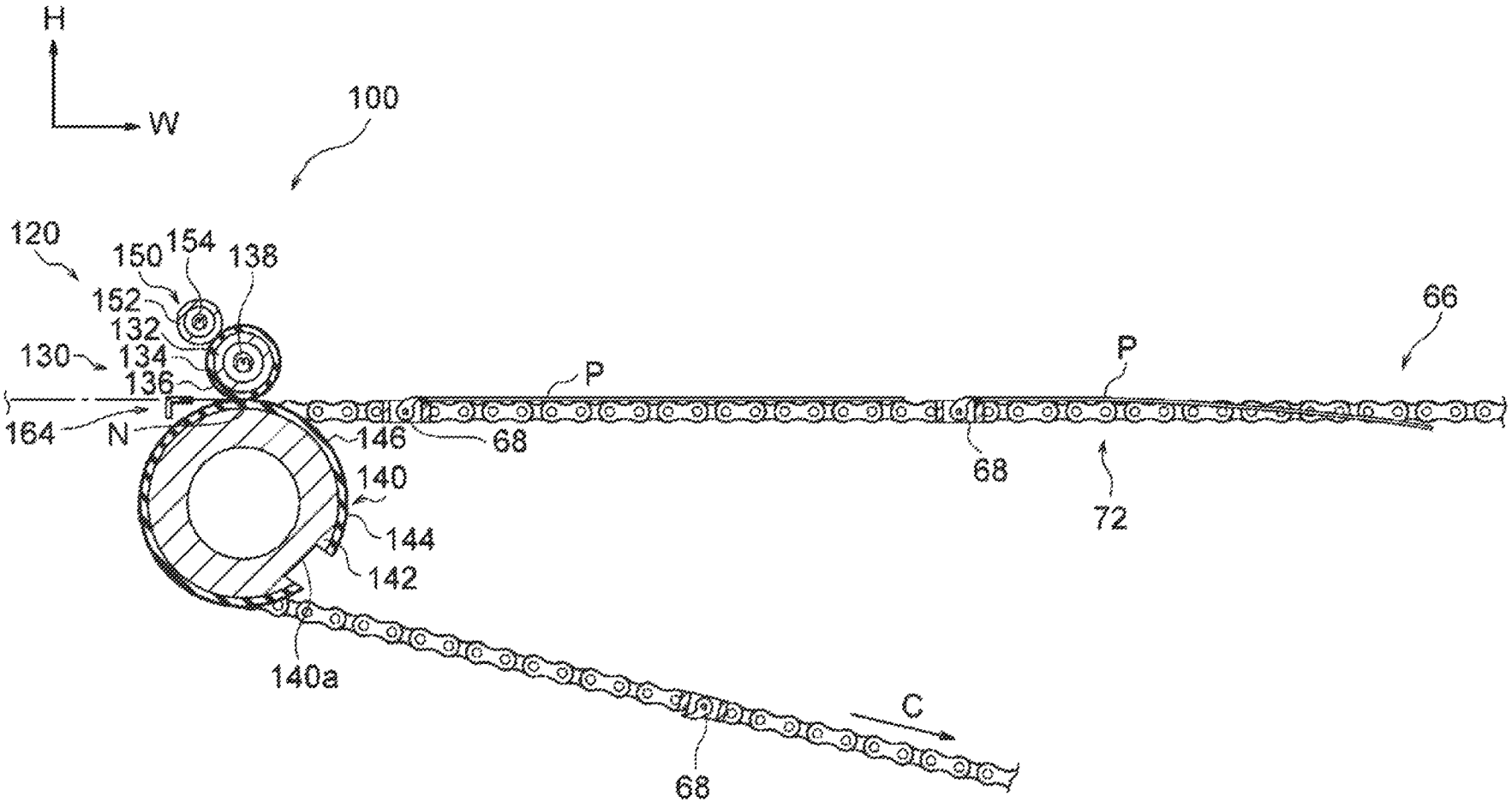
FIG. 6 is a front view illustrating members such as a fixation part provided in the image forming apparatus according to the first exemplary embodiment of the present disclosure.

The fixation unit 120 is disposed as illustrated in FIG. 6. The fixation unit 120 makes contact with the transported sheet member P to heat a toner image and thereby fixes the toner image onto the sheet member P. Details of the fixation unit 120 will be described later.

Operation of Image Forming Apparatus 10

Next, operation of the image forming apparatus 10 is described.

The feeding roll 62 illustrated in FIG. 1 feeds a sheet member P stored in the storage 50 to the transport path 54. The plural transport rolls 64 receive the sheet member P fed to the transport path 54, transports the sheet member P, and delivers the sheet member P to the gripping part 68 of the chain gripper 66. The gripping part 68 transports the sheet member P to the secondary transfer position NT in a state where a front end of the sheet member P is gripped by the grippers 76. Then, the transfer part 35 transfers a toner image transferred onto the transfer belt 31 onto the sheet member P that passes the secondary transfer position NT by electrostatic force generated by the secondary transfer roll 34.

The gripping part 68 transports the sheet member P to the fixation unit 120. The fixation unit 120 fixes the toner image onto the sheet member P.

Furthermore, as illustrated in FIG. 1, the gripping part 68 delivers the sheet member P onto which the toner image has been fixed to the cooling rolls 92 of the cooling part 90. Then, the cooling rolls 92 transport the sheet member P while cooling the sheet member P and discharge the cooled sheet member P to the discharge part 52.

Configuration of Substantial Part

Next, the fixation unit 120 is described. The fixing unit is an example of a fixation device.

As illustrated in FIG. 6, the fixation unit 120 includes a heating roll 130 that heats a toner image while making contact with a sheet member P transported by the gripping part 68 and the pressing roll 140 around which a part of the sheet member P is wound and that presses the sheet member P toward the heating roll 130. Furthermore, the fixation unit 120 includes a driven roll 150 that rotates so as to follow the heating roll 130.

Furthermore, as illustrated in FIG. 4, the fixation unit 120 includes peeling parts 164 that peel the sheet member P wound around the pressing roll 140 off from the pressing roll 140 by lifting a front end of the sheet member P up while rotating. Furthermore, the fixation unit 120 includes a shaft part 162 about which the peeling parts 164 rotate, a pair of rotating parts 180 that rotate the peeling parts 164 about the shaft part 162, and a pair of reducing parts 196 that reduce momentum of the peeling parts 164 lifting the front end of the sheet member P up.

Heating Roll 130

As illustrated in FIG. 6, the heating roll 130 is disposed in contact with a surface of a transported sheet member P that faces upward and extends in the apparatus depth direction so that an axial direction thereof is the apparatus depth direction. The heating roll 130 includes a cylindrical base member 132, a rubber layer 134 formed so as to cover an entire circumference of the base member 132, a release layer 136 formed so as to cover an entire circumference of the rubber layer 134, and a heater 138 stored inside the base member 132.

As illustrated in FIG. 4, a shaft part 139*a* extending in the apparatus depth direction is provided at both ends of the heating roll 130 in the apparatus depth direction. Furthermore, support members 139*b* that support the respective shaft parts 139*a* are disposed. With this configuration, the heating roll 130 is rotatably supported by the support members 139*b* at both ends of the heating roll 130.

Driven Roll 150

As illustrated in FIG. 6, the driven roll 150 is disposed on a side opposite to a transported sheet member P with the heating roll 130 interposed therebetween and extends in the apparatus depth direction so that an axial direction thereof is the apparatus depth direction. The driven roll 150 has a cylindrical base member 152 and a heater 154 stored inside the base member 152.

In this configuration, the driven roll 150 rotates so as to follow the heating roll 130. The driven roll 150 heats the heating roll 130. Since the heating roll 130 is heated by the driven roll 150 and the heating roll 130 itself has the heater 138, a surface temperature of the heating roll 130 becomes a predetermined value that is equal to or larger than 180° C. and equal to or less than 200° C.

Pressing Roll 140, Others

As illustrated in FIG. 6, the pressing roll 140 is disposed so as to be in contact with a surface of a transported sheet member P that faces downward on a side opposite to the heating roll 130 with the transported sheet member P interposed therebetween and extends in the apparatus depth direction so that an axial direction thereof is the apparatus depth direction. The pressing roll 140 has a cylindrical base member 142, a rubber layer 144 formed so as to cover the base member 142, a release layer 146 formed so as to cover the rubber layer 144, and a pair of shaft parts 148 (see FIG. 4) provided at both ends thereof in the apparatus depth direction.

As illustrated in FIG. 5, a recessed part 140*a* extending in the apparatus depth direction is provided on an outer circumferential surface of the pressing roll 140. In a case where a sheet member P passes between the pressing roll 140 and the heating roll 130, the gripping part 68 that transports the sheet member P is stored in the recessed part 140*a*.

As illustrated in FIG. 4, the pair of shaft parts 148 are provided at both ends in the apparatus depth direction, have a smaller diameter than an outer circumferential surface of the release layer 146 of the pressing roll 140, and extends in the axial direction.

Furthermore, the fixation unit 120 includes a pair of support members 156 that support the pressing roll 140 and a pair of biasing members 158 that bias the pressing roll 140 toward the heating roll 130 through the support members 156. The pair of support members 156 are disposed so as to rotatably support the pair of shaft parts 148 of the pressing roll 140 from below.

The pair of biasing members 158 are compression coil springs and are disposed on a side opposite to the shaft parts 148 with the support members 156 interposed therebetween.

In this configuration, the pair of biasing members 158 bias the pressing roll 140 toward the heating roll 130. Furthermore, the pressing roll 140 that is rotated by rotational force transmitted from a driving member (not illustrated) presses the sheet member P toward the heating roll 130.

Furthermore, the heating roll 130 rotates so as to follow the rotating pressing roll 140, and the driven roll 150 rotates so as to follow the rotating heating roll 130. The heating roll 130 and the pressing roll 140 transport a sheet member P while holding the sheet member P at a nip part NP formed by the pressing roll 140 and the heating roll 130, and thereby a toner image is fixed onto the sheet member P.

Peeling Parts 164, Shaft Part 162, Rotating Parts 180

Peeling Parts 164, Shaft Part 162

As illustrated in FIG. 4, the peeling parts 164 are disposed apart from one another in the apparatus depth direction on the other side (left side in FIG. 4) relative to the nip part NP formed by the pressing roll 140 and the heating roll 130 in the apparatus width direction. Specifically, the peeling parts 164 are disposed so as not to overlap the grippers 76 in the apparatus depth direction.

Figure 7A:
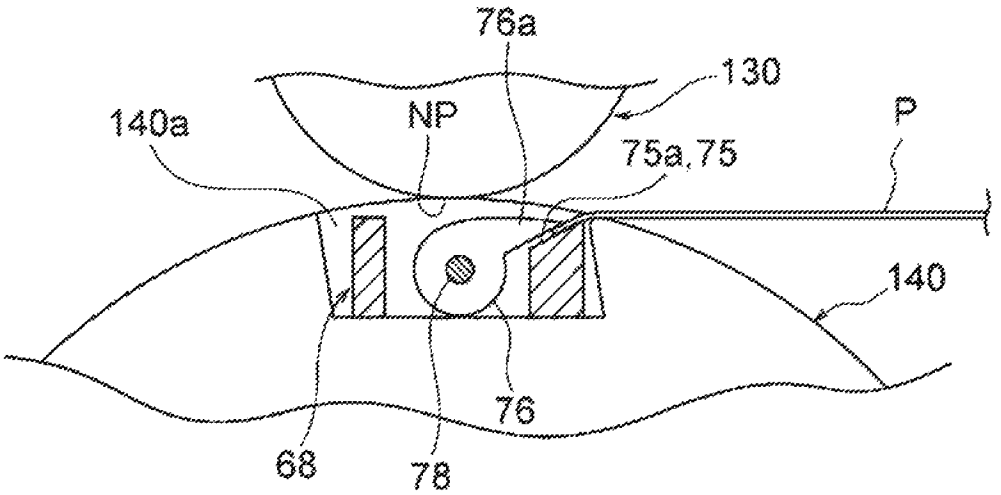
FIGS. 7A and 7B are operation diagrams illustrating members such as a peeling part provided in the fixation unit according to the first exemplary embodiment of the present disclosure.
Figure 7B:
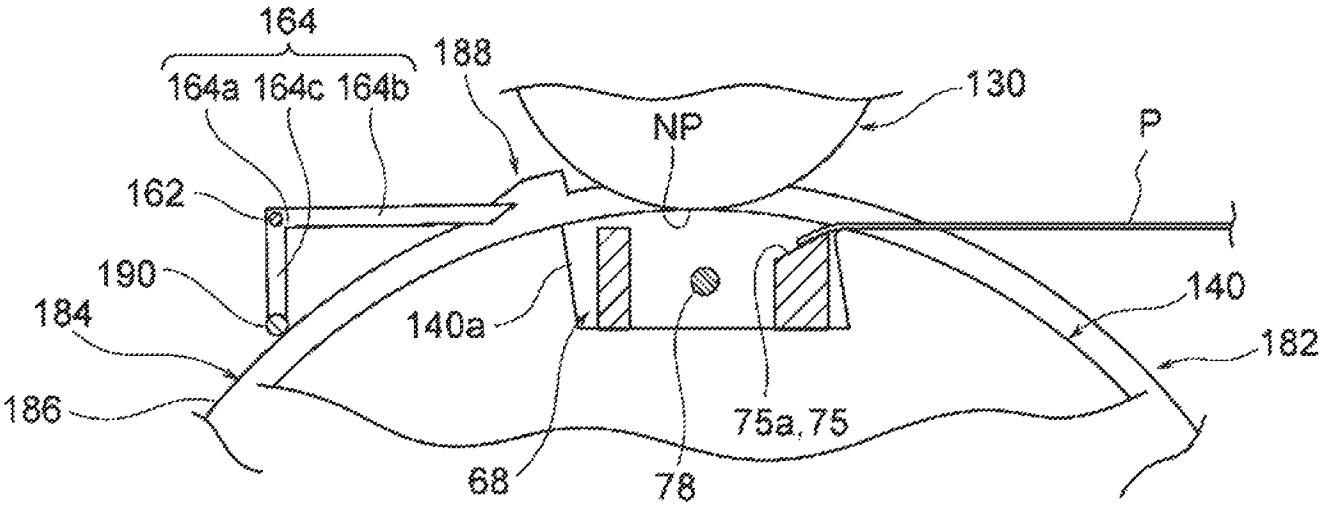

As illustrated in FIG. 7B, each of the peeling parts 164 has an L shape when viewed from the apparatus depth direction and has a first part 164*b* extending from a bent part 164*a* toward one side (right side in FIG. 7B) in the apparatus width direction and a second part 164*c* extending downward from the bent part 164*a*. Specifically, the first part 164*b* extends from the bent part 164*a* toward the nip part NP formed by the pressing roll 140 and the heating roll 130.

The first part 164*b* has a plate shape whose thickness direction is the apparatus top-bottom direction, and a front end of the first part 164*b* is tapered. The second part 164*c* has a plate shape whose thickness direction is the apparatus width direction. The shaft part 162 is attached to the bent part 164*a* of the peeling part 164.

As illustrated in FIG. 4, the shaft part 162 has a columnar shape extending along the axial direction of the pressing roll 140 and is rotatably supported by a frame member (not illustrated) at both ends thereof. With this configuration, when the shaft part 162 rotates, the peeling part 164 also rotates.

Rotating Part 180

As illustrated in FIG. 4, the pair of rotating parts 180 are disposed on both sides of the pressing roll 140 in the apparatus depth direction. Each of the rotating parts 180 includes a cam 182, a contact part 190 that makes contact with a cam surface 184 of the cam 182, and a biasing part 192 that biases the contact part 190 toward the cam surface 184.

As illustrated in FIG. 4, the cam 182 has a disc shape and is attached to the shaft part 148 of the pressing roll 140. An external diameter of the cam 182 is larger than an external shape of the pressing roll, and the cam surface 184 is formed on an outer circumference of the cam 182.

Figure 13A:
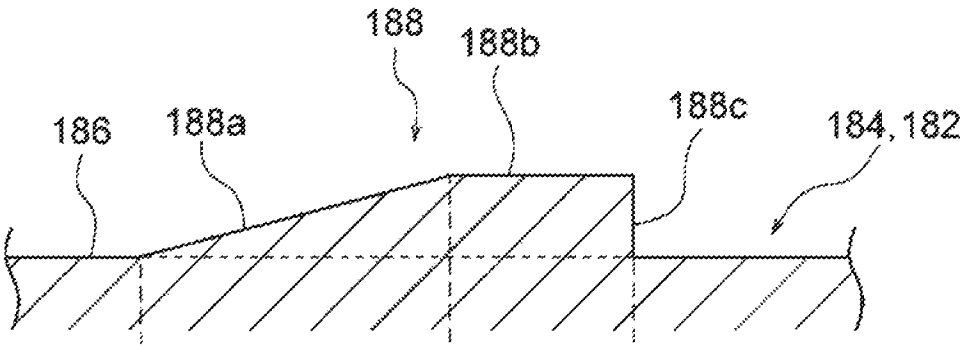
FIGS. 13A and 13B are an enlarged view illustrating a shape of a cam surface of a cam provided in the fixation unit according to the first exemplary embodiment of the present disclosure and a diagram illustrating a relationship between a rotation angle of the peeling part and a rotation angle of the cam provided in the fixation unit.

As illustrated in FIG. 13A, the cam surface 184 has a protruding part 188 protruding from a circular general surface 186. The protruding part 188 has an inclined surface 188*a* inclined with respect to a direction of a tangent to the general surface 186 when viewed from the axial direction, an offset surface 188*b* that extends from an end of the inclined surface 188*a* and is offset to an outer side in a radial direction relative to the general surface 186, and a step surface 188*c* that forms a step to the general surface 186 on a side opposite to the inclined surface 188*a* with the offset surface 188*b* interposed therebetween. In FIG. 13A, the circular general surface 186 is illustrated as having a linear shape so that the shape of the protruding part 188 can be easily understood.

As illustrated in FIGS. 4 and 7B, the contact part 190 has a columnar shape extending in the apparatus depth direction and is attached to a lower end of the second part 164*c* of the peeling part 164. A circumferential surface of the contact part 190 at both end portions thereof is in contact with the cam surfaces 184 of the cams 182.

The biasing parts 192 are disposed on both sides of the contact part 190 in the apparatus depth direction, respectively and each include a coil spring 192*a* whose one end makes contact with the contact part 190 and that biases the contact part 190 toward the cam surface 184 and a support part 192*b* that makes contact with the other end of the coil spring 192*a* and supports the coil spring 192*a*.

In this configuration, the biasing parts 192 bias the contact part 190 toward the cam surface 184, so that a state where the contact part 190 is in contact with the cam surface 184 is maintained. In a state where the contact part 190 is in contact with the general surface 186 of the cam surface 184, the peeling parts 164 are disposed at a standby position, and front ends of the first parts 164*b* of the peeling parts 164 are separate from an outer circumferential surface of the pressing roll 140, as illustrated in FIG. 7B.

When the cams 182 rotate together with rotation of the pressing roll 140, the contact part 190 makes contact with the protruding part 188 provided on the cam surface 184 and thereby moves to rotate the shaft part 162. As a result, the front ends of the first parts 164*b* of the peeling parts 164 make contact with the contact surface 75*a* of the gripping part 68 stored in the recessed part 140*a*, as illustrated in FIG. 10B. In this state, the peeling parts 164 are disposed at an operating position.

The cam 182 further rotates, and the contact part 190 passes the protruding part 188 of the cam surface 184. As a result, the shaft part 162 rotates. This causes the peeling parts 164 to return from the operating position to the standby position, as illustrated in FIG. 11B. Since the peeling parts 164 return to the standby position, the peeling parts 164 lift a front end of the sheet member P up. In this way, the peeling parts 164 peel the sheet member P off from the pressing roll 140. Detail of the rotating action of the peeling parts 164 will be described later together with operation.

Reducing Parts 196

As illustrated in FIG. 4, the pair of reducing parts 196 are disposed at both ends of the shaft part 162 in the apparatus depth direction. Each of the reducing parts 196 includes a lever member 196*a* that is attached to an end of the shaft part 162 and extends in a radial direction of the shaft part 16 and a compression coil spring 196*b* (hereinafter referred to as a "coil spring") that makes contact with a front end of the lever member 196*a* at one end thereof and biases the lever member 196*a*. Furthermore, the reducing part 196 includes a support part 196*c* that makes contact with the other end of the coil spring 196*b* and supports the coil spring 196*b*.

Figure 12A:
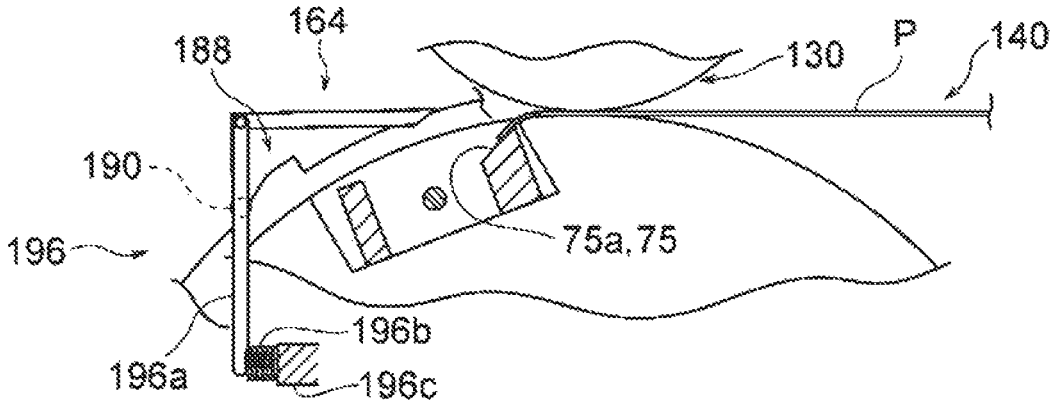
FIGS. 12A, 12B, and 12C are operation diagrams illustrating a reducing part provided in the fixation unit according to the first exemplary embodiment of the present disclosure.
Figure 12B:
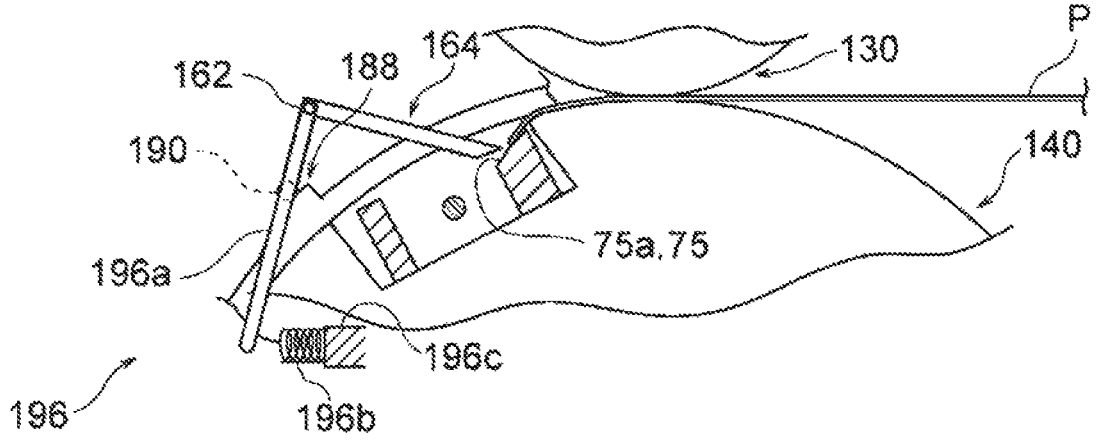

Specifically, in a state where the peeling parts 164 are disposed at the standby position, one end of the coil spring 196*b* is in contact with the front end of the lever member 196*a*, and the coil spring 196*b* is elastically deformed so as to be compressed, as illustrated in FIG. 12A. Meanwhile, in a state where the peeling parts 164 are disposed at the operating position, the one end of the coil spring 196*b* is separate from the front end of the lever member 196*a*, as illustrated in FIG. 12B.

In this way, the coil spring 196*a* biases the lever member 196*a* so as to reduce momentum of movement of the peeling parts 164 disposed at the operating position toward the standby position. Reducing momentum of the peeling parts 164 means exerting braking force on the movement of the peeling parts 164.

Biasing force by which the coil spring 196*b* illustrated in FIG. 12A biases the lever member 196*a* is weaker than biasing force by which the coil spring 192*a* illustrated in FIG. 4 biases the contact part 190. That is, a contact state between the contact part 190 and the cam surface 184 is maintained by biasing force of the coil spring 192*a*. In other words, the biasing force of the coil spring 196*b* prevents the contact part 190 and the cam surface 184 from being separated from each other.

Note that details of other operation of the reducing parts 196 will be described later together with operation.

Operation of Configuration of Substantial Part

Next, operation of the fixation unit 120 is described. As for the cams 182 illustrated in FIGS. 7 to 12, only the cam surface 184 is illustrated so that a relationship between the gripping part 68 and the peeling parts 164 can be easily understood.

As illustrated in FIG. 7A, the gripping part 68 that transports a sheet member P while gripping a front end of the sheet member P between the claws 76*a* of the grippers 76 and the contact surface 75*a* of the attachment member 75 is stored in the recessed part 140*a* of the pressing roll 140. This causes a part of the sheet member P to be wound around the pressing roll 140.

Meanwhile, the contact part 190 is in contact with the general surface 186 of the cam surface 184 as illustrated in FIG. 7B, and the peeling parts 164 are disposed at the standby position. In the state where the peeling parts 164 are disposed at the standby position, one end of the coil spring 196*b* makes contact with a front end of the lever member 196*a*, so that the coil spring 196*b* is elastically deformed so as to be compressed, as illustrated in FIG. 12A.

Figure 8A:
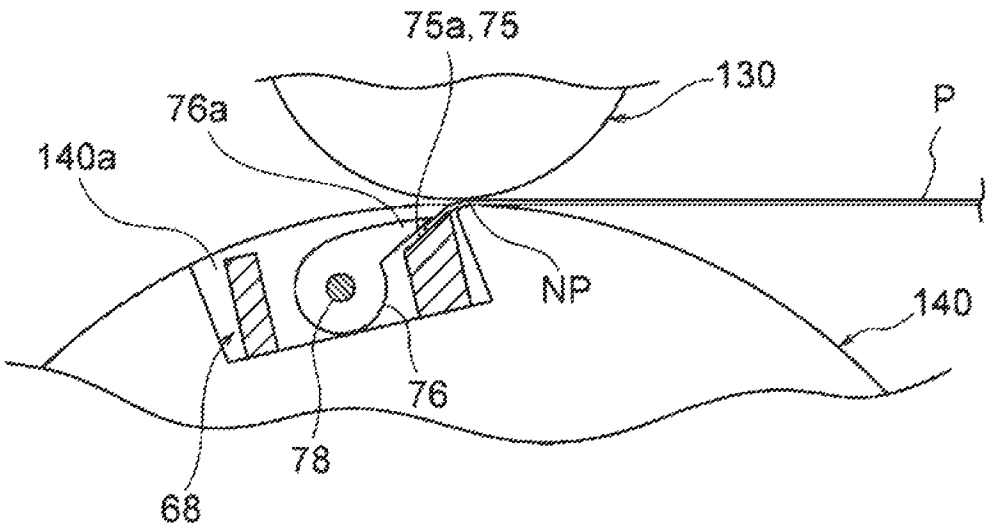
FIGS. 8A and 8B are operation diagrams illustrating the members such as the peeling part provided in the fixation unit according to the first exemplary embodiment of the present disclosure.
Figure 8B:
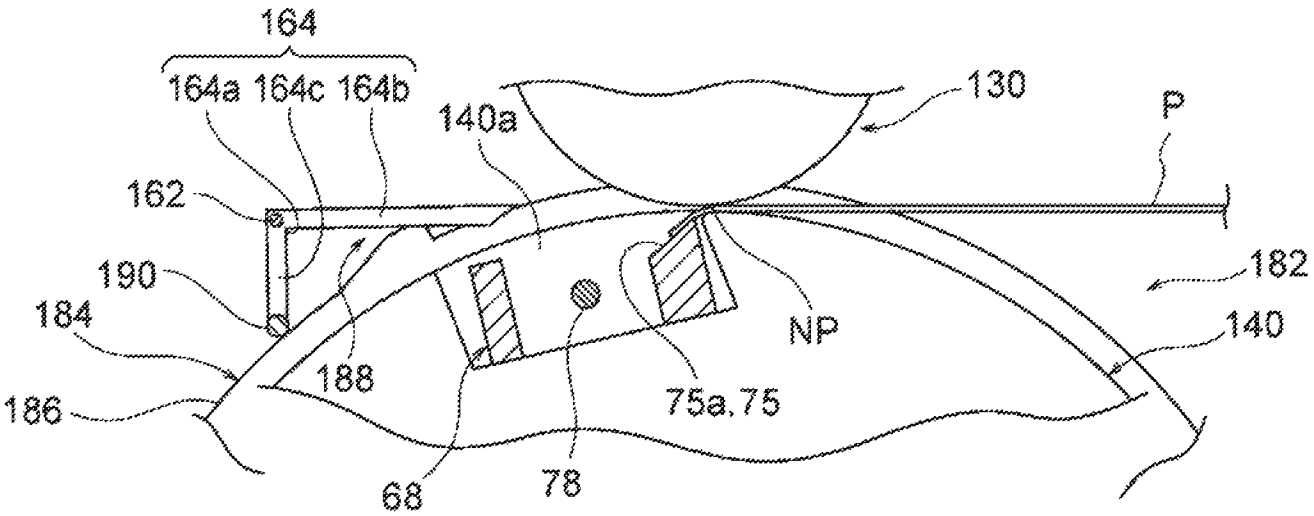

Furthermore, when the pressing roll 140 rotates and the gripping part 68 stored in the recessed part 140*a* moves together with movement of the recessed part 140*a*, a portion of the sheet member P on a front end side is held by the nip part NP, as illustrated in FIG. 8A. A part of the sheet member P is wound around the pressing roll 140. Meanwhile, the contact part 190 is in contact with the general surface 186 of the cam surface 184 as illustrated in FIG. 8B, and the peeling parts 164 are disposed at the standby position.

Figure 9A:
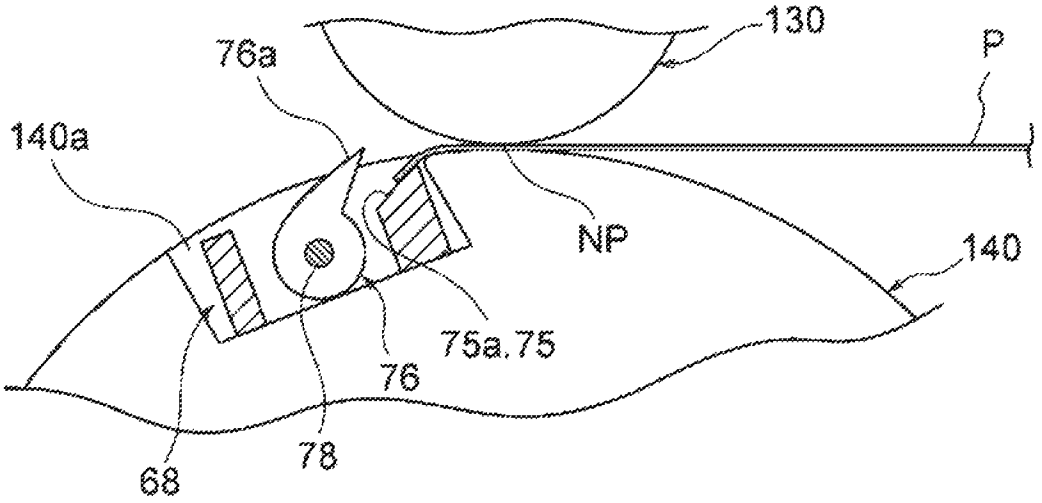
FIGS. 9A and 9B are operation diagrams illustrating the members such as the peeling part provided in the fixation unit according to the first exemplary embodiment of the present disclosure.

Furthermore, when the pressing roll 140 rotates and the gripping part 68 stored in the recessed part 140*a* moves together with movement of the recessed part 140*a*, the grippers 76 rotate due to operation of a cam or the like (not illustrated), as illustrated in FIG. 9A. The claws 76*a* of the grippers 76 are separated from the contact surface 75*a* of the attachment member 75. As a result, the gripping part 68 is no longer gripping the front end of the sheet member P.

Figure 9B:
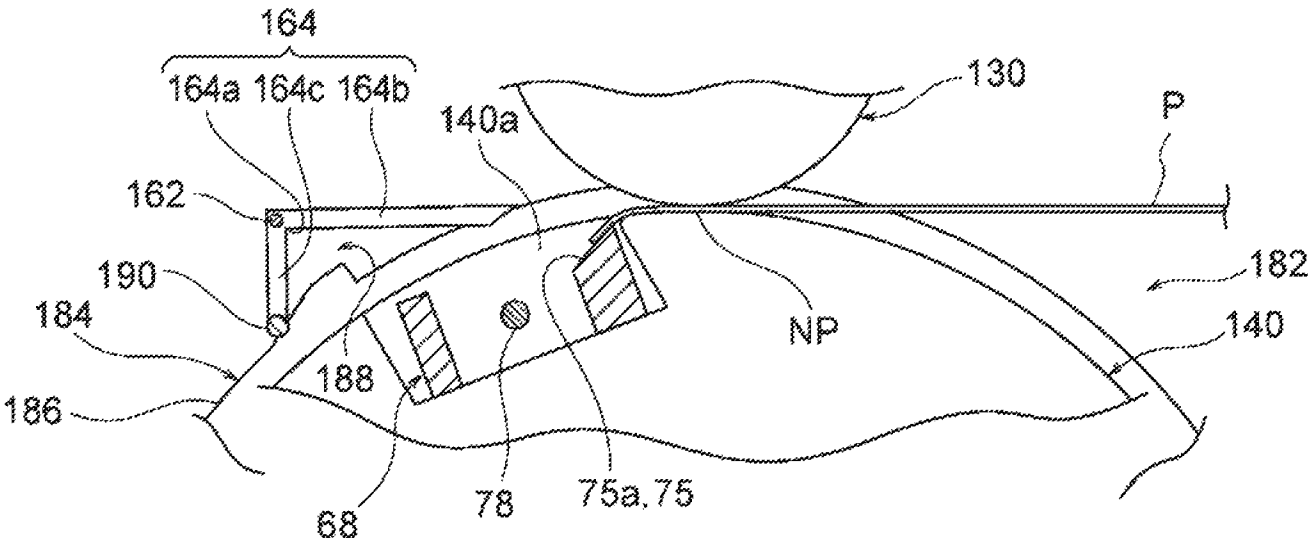

Meanwhile, the contact part 190 is in contact with the general surface 186 of the cam surface 184 as illustrated in FIG. 9B, and the peeling parts 164 are disposed at the standby position. Furthermore, the protruding part 188 provided on the cam surface 184 of the rotating cam 182 reaches the contact part 190.

Figure 10A:
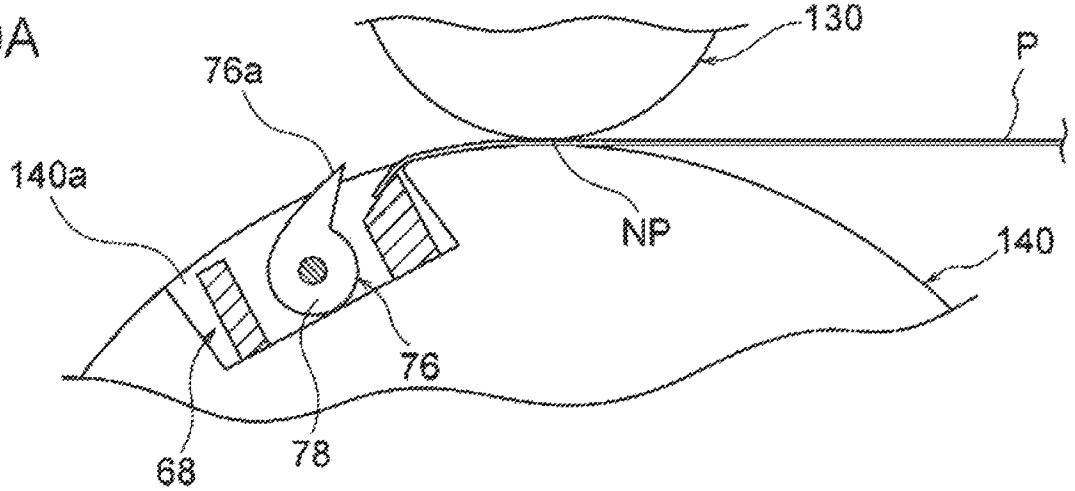
FIGS. 10A and 10B are operation diagrams illustrating the members such as the peeling part provided in the fixation unit according to the first exemplary embodiment of the present disclosure.
Figure 10B:
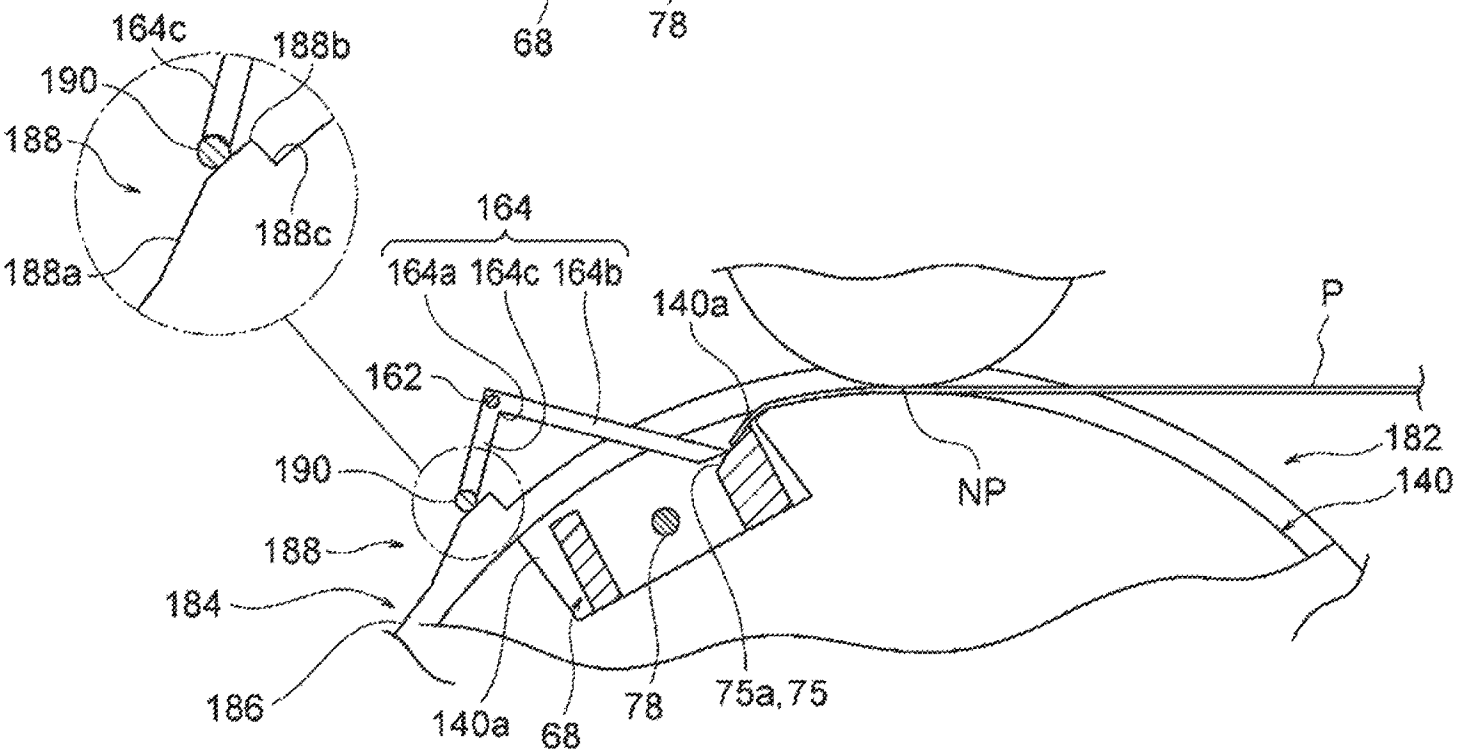

Furthermore, when the pressing roll 140 rotates and the gripping part 68 stored in the recessed part 140*a* moves together with movement of the recessed part 140*a*, a portion of the sheet member P that has passed the nip part NP increases, as illustrated in FIG. 10A. Note that the gripping part 68 is no longer gripping the front end of the sheet member P.

Meanwhile, the contact part 190 passes the inclined surface 188*a* of the protruding part 188 of the cam surface 184 and reaches the offset surface 188*b*, as illustrated in FIG. 10B. This causes the peeling parts 164 disposed at the standby position to rotate and be disposed at the operating position. The front ends of the first parts 164*b* of the peeling parts 164 make contact with the contact surface 75*a* and face an end surface of the sheet member P.

When the peeling parts 164 disposed at the standby position move and are disposed at the operating position, the lever member 196*a* rotates, and the front end of the lever member 196*a* is separated from one end of the coil spring 196*b*, as illustrated in FIG. 12B.

Figure 13B:
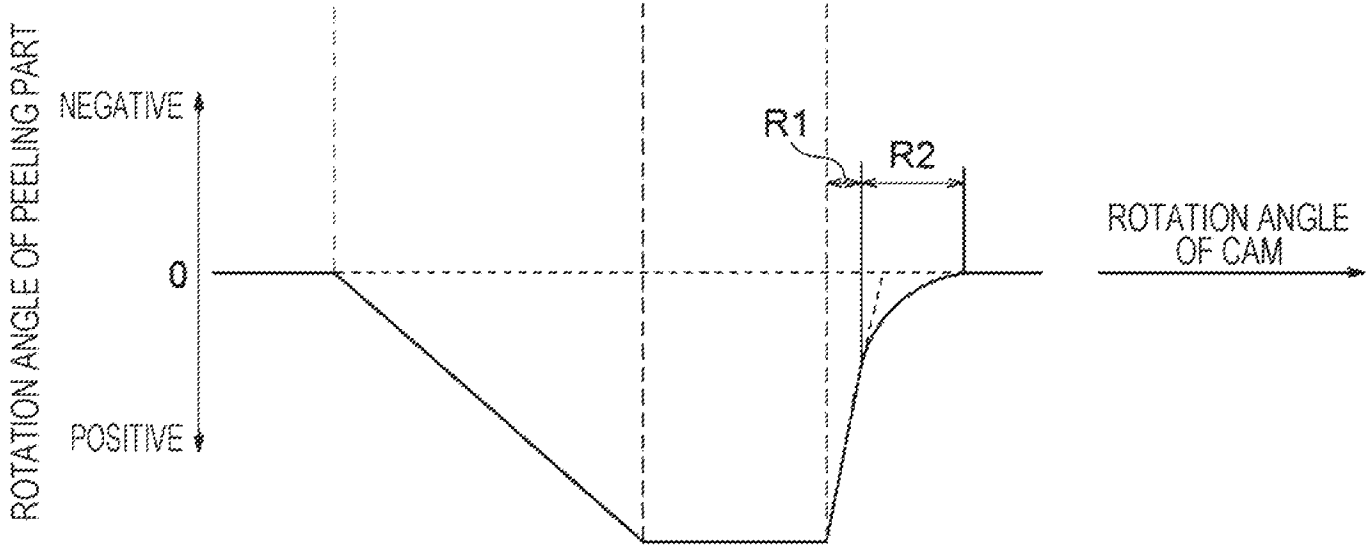

A rotation angle of the peeling parts 164 is described by using the graph illustrated in FIG. 13B. In this graph, the horizontal axis represents a rotation angle of the cam 182, and the vertical axis represents a rotation angle of the peeling parts 164. Note that the rotation angle of the peeling parts 164 is 0° C. in the state where the peeling parts 164 are disposed at the standby position.

Furthermore, the graph of FIG. 13B corresponds to the cam surface 184 of FIG. 13A. Specifically, when the contact part 190 passes the inclined surface 188*a* of the protruding part 188 of the cam surface 184 and reaches the offset surface 188*b* as illustrated in FIG. 10B, the peeling parts 164 rotate in a positive direction, as illustrated in the graph of FIG. 13B. Furthermore, while the contact part 190 is in contact with the offset surface 188*b*, rotation of the peeling parts 164 is stopped.

Figure 11A:
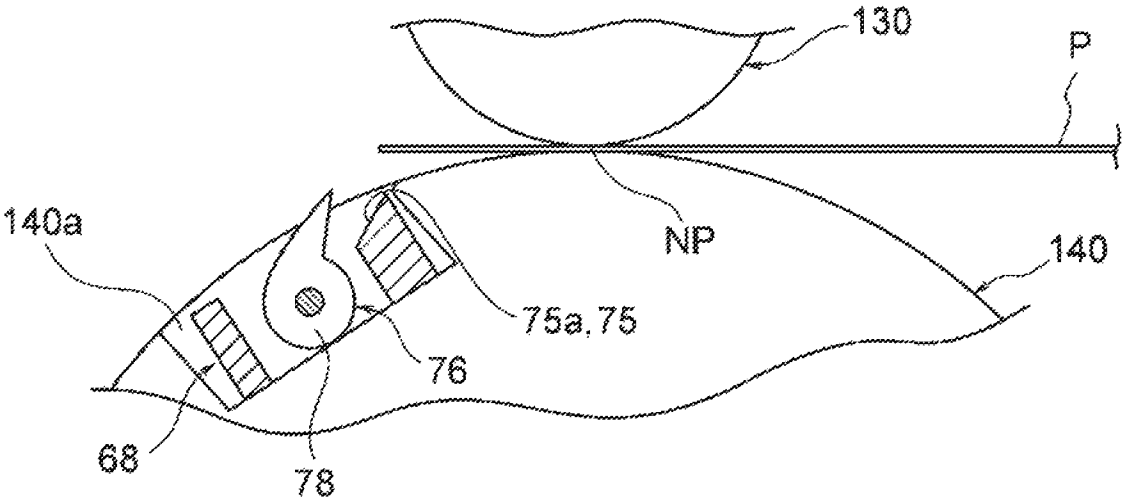
FIGS. 11A and 11B are operation diagrams illustrating the members such as the peeling part provided in the fixation unit according to the first exemplary embodiment of the present disclosure.
Figure 11B:
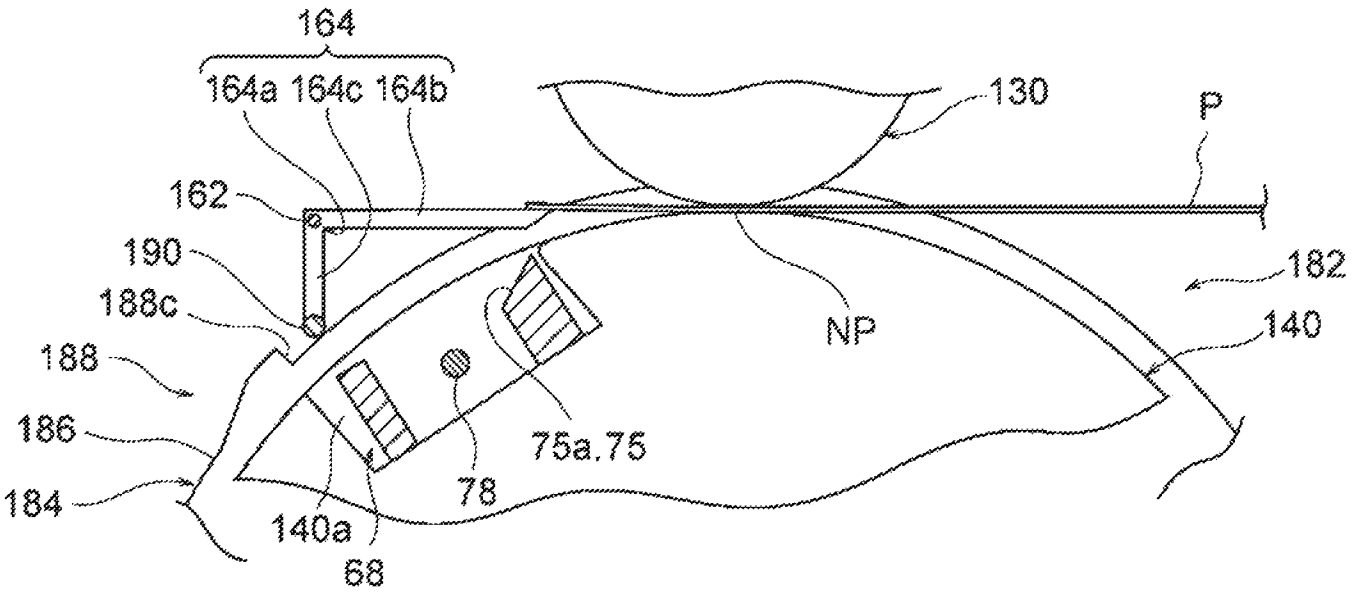

Furthermore, when the pressing roll 140 rotates and the gripping part 68 stored in the recessed part 140*a* moves together with movement of the recessed part 140*a*, a portion of the sheet member P that has passed the nip part NP increases, as illustrated in FIG. 11A. Note that the gripping part 68 is no longer gripping the front end of the sheet member P. Furthermore, the front end of the sheet member P is placed on the first parts 164*b* of the peeling parts 164.

Meanwhile, the contact part 190 passes the step surface 188*c* of the protruding part 188 of the cam surface 184 and makes contact with the general surface 186, as illustrated in FIG. 11B. This causes the peeling parts 164 disposed at the operating position to rotate and lift the front end of the sheet member P up and return to the standby position. In this way, the front end of the sheet member P is lifted up by the peeling parts 164, and thereby the sheet member P is peeled off from the pressing roll 140.

Figure 12C:
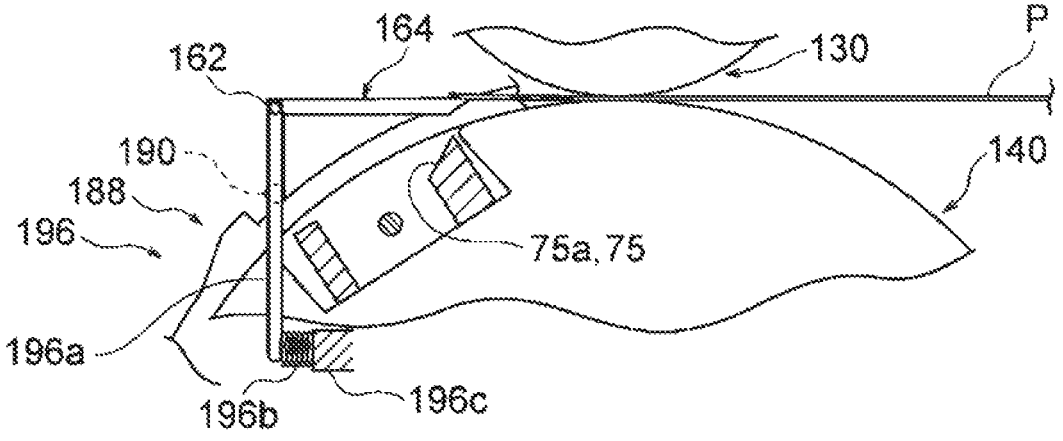

When the peeling parts 164 disposed at the operating position rotate and are disposed at the standby position, the front end of the lever member 196*a* makes contact with one end of the coil spring 196*b*, and the coil spring 196*b* is compressed, as illustrated in FIG. 12C. In other words, the coil spring 196*b* is compressed by lifting force lifting the front end of the sheet member P up.

Specifically, when the contact part 190 passes the step surface 188*c* of the protruding part 188 of the cam surface 184 and makes contact with the general surface 186 as illustrated in FIG. 11B, the peeling parts 164 rotate in a negative direction, as illustrated in the graph of FIG. 13B.

A change rate of a rotation angle of a former part (R1 in FIG. 13B) of rotation of the peeling parts 164 in the negative direction and a change rate of a rotation angle of a latter part (R2 in FIG. 13B) of rotation of the peeling parts 164 in the negative direction are different. Specifically, the change rate of the rotation angle of the latter part R2 is smaller than the change rate of the rotation angle of the former part R1. In other words, momentum of rotation of the peeling parts 164 is reduced in the latter part R2. Further in other words, momentum of the peeling parts 164 lifting the front end of the sheet member P up is reduced in the latter part R2.

The momentum is reduced in the latter part R2 because the front end of the lever member 196*a* makes contact with one end of the coil spring 196*b*, and the coil spring 196*b* is compressed, as illustrated in FIG. 12C. In this way, in the latter part R2, the reducing part 196 including the coil spring 196*b* reduces momentum of the peeling parts 164 lifting the front end of the sheet member P up.

In a case where the momentum lifting the front end of the sheet member P up is not reduced, there is a risk of occurrence of a situation where the front end of the sheet member P is moved toward the heating roll 130 by the momentum of the peeling parts 164 lifting the front end of the sheet member P up and the sheet member P is wound around the heating roll 130.

SUMMARY

As described above, in the fixation unit 120, the momentum of the peeling parts 164 lifting the front end of the sheet member P up is reduced in the latter part R2. Therefore, the sheet member P is less likely to be wound around the heating roll 130 than in a case where the peeling parts lift the front end of the sheet member P up without reducing the momentum.

In the fixation unit 120, the coil spring 196*b* is elastically deformed so as to be compressed by lifting force by which the front end of the sheet member P is lifted up by the peeling parts 164. In this way, the momentum lifting the front end of the sheet member P up is reduced in the latter part R2 by the elastic deformation of the coil spring 196*b*. Therefore, the momentum lifting the front end of the sheet member P up is reduced with a simpler configuration than in a case where the momentum of the peeling parts is reduced by frictional force. Furthermore, a degree of the reduction can be easily adjusted by changing a spring constant of the coil spring 196*b* as compared with a case where the momentum lifting the front end of the sheet member P up is reduced by elastically deforming a rubber member.

In the fixation unit 120, the front end of the sheet member P is lifted up by rotation of the peeling parts 164. This narrows an operation range of the peeling parts 164 as compared with a case where the front end of the sheet member P is lifted up by moving the peeling parts in parallel.

In the fixation unit 120, rotational force of the pressing roll 140 is transmitted to rotate the cam 182. This reduces the number of components as compared with a case where a dedicated driving member for rotating a cam is provided.

In the image forming apparatus 10, a fixation defect is less likely to occur than in a case where the fixation unit 120 is not provided.

Second Exemplary Embodiment

An example of a fixation unit according to a second exemplary embodiment of the present disclosure is described in accordance with FIG. 14. In the second exemplary embodiment, differences from the first exemplary embodiment are mainly described.

Figure 14A:
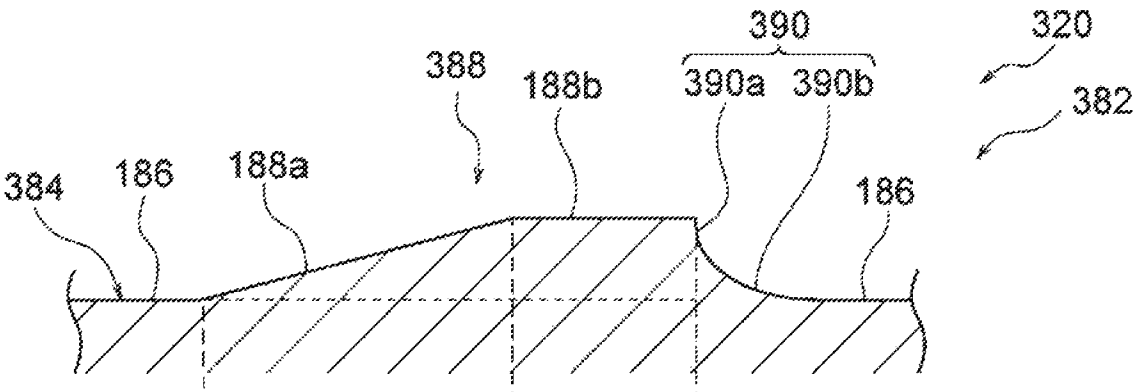
FIGS. 14A and 14B are an enlarged view illustrating a shape of a cam surface of a cam provided in a fixation unit according to a second exemplary embodiment of the present disclosure and a diagram illustrating a relationship between a rotation angle of a peeling part and a rotation angle of the cam provided in the fixation unit.

A fixation unit 320 according to the second exemplary embodiment does not include the reducing part 196. A cam surface 384 of a cam 382 of the fixation unit 320 has a general surface 186 and a protruding part 388 protruding from the general surface 186, as illustrated in FIG. 14A. The protruding part 388 has an inclined surface 188*a*, an offset surface 188*b*, and a step surface 390.

The step surface 390 is a curved surface that is recessed when viewed from the apparatus depth direction, and a radius of curvature of a former part 390*a* of the step surface 390 close to the offset surface 188*b* is smaller than a radius of curvature of a latter part 390*b* of the step surface 390 close to the general surface 186. In other words, the radius of curvature of the latter part 390*b* is larger than the radius of curvature of the former part 390*a*.

Figure 14B:
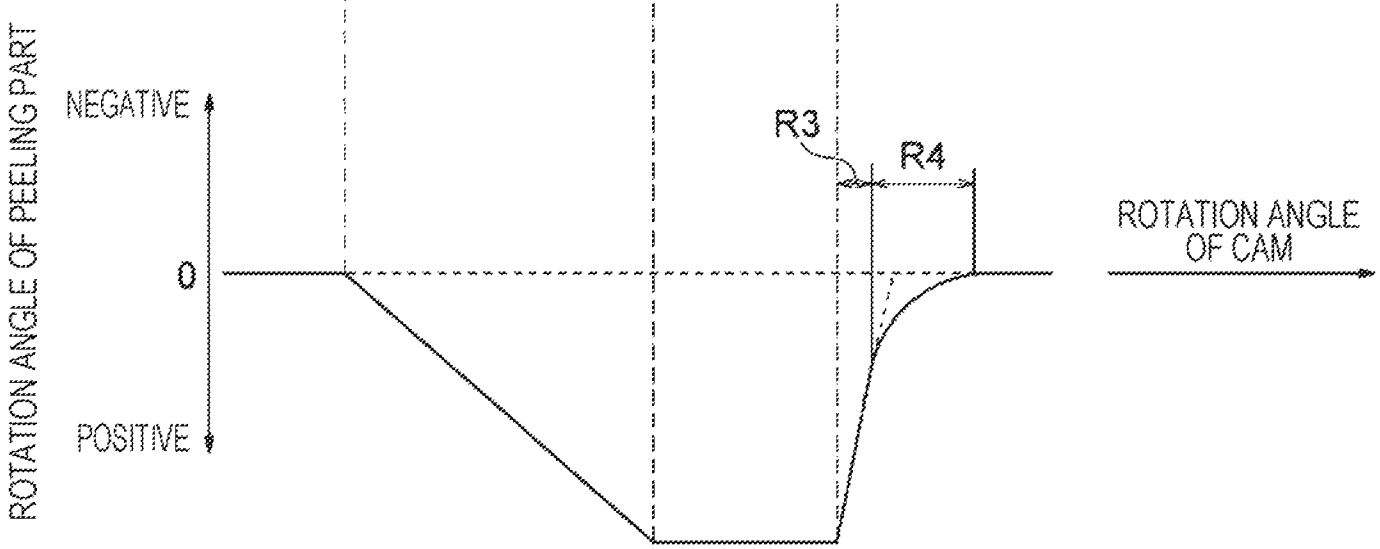

Accordingly, as illustrated in the graph of FIG. 14B, a change rate of a rotation angle of a former part (R3 in FIG. 14B) of rotation of peeling parts 164 in a negative direction and a change rate of a rotation angle of a latter part (R4 in FIG. 14B) of rotation of the peeling parts 164 in the negative direction are different. Specifically, the change rate of the rotation angle of the latter part R4 is smaller than the change rate of the rotation angle of the former part R2. In other words, momentum of rotation of the peeling parts 164 is reduced in the latter part R4. Further in other words, momentum of the peeling parts 164 lifting a front end of a sheet member P up is reduced in the latter part R4. In this way, the step surface 390 functions as a reducing part that reduces momentum of the peeling parts 164 lifting the front end of the sheet member P up in the latter part R4.

Other effects of the second exemplary embodiment are similar to those other than the effects produced by the reducing part 196 in the first exemplary embodiment.

Although the specific exemplary embodiments of the present disclosure have been described in detail, the present disclosure is not limited to such exemplary embodiments, and it is apparent to a person skilled in the art that other various exemplary embodiments can be made within the scope of the present disclosure. For example, although the coil spring 196*b* is elastically deformed so as to be compressed by lifting force lifting the front end of the sheet member P up and thereby momentum lifting the front end of the sheet member P up is reduced in the latter part R2 in the first exemplary embodiment, the momentum lifting the front end of the sheet member P up may be reduced by frictional force. In this case, the effects produced by elastic deformation of the coil spring 196*b* are not produced.

Although the coil spring 196*b* is elastically deformed in the first exemplary embodiment, for example, a rubber member or the like may be elastically deformed. In this case, the effects produced by elastic deformation of the coil spring 196*b* are not produced.

Although the peeling parts 164 are rotated in the above exemplary embodiments, the peeling parts 164 may be moved in parallel. In this case, the effects produced by rotation of the peeling parts 164 are not produced.

Although the cam 182 or 382 is rotated by rotational force of the pressing roll 140 in the above exemplary embodiments, the cam 182 or 382 may be rotated by rotational force transmitted from a dedicated driving member. In this case, the effects produced by rotation of the cam 182 or 382 by rotational force of the pressing roll 140 are not produced.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixation device comprising:

a heating roll that heats a transported recording medium whose front end is gripped by a gripping part while rotating;

a pressing roll that is disposed so as to face the heating roll, around which at least a part of the transported recording medium is wound, and presses the wound part of the recording medium toward the heating roll while rotating;

a peeling arm that peels the recording medium off from the pressing roll by lifting the front end of the recording medium up in a state where the front end of the recording medium has passed a portion where the pressing roll and the heating roll face each other and is no longer gripped by the gripping part; and a reducing lever assembly that reduces momentum of the peeling arm lifting the front end of the recording medium up.

2. The fixation device according to claim 1, wherein:

the reducing lever assembly includes an elastic member that is elastically deformed by lifting force by which the peeling arm lifts the front end of the recording medium up.

3. The fixation device according to claim 2, wherein:

the elastic member is a compression coil spring.

4. The fixation device according to claim 3, further comprising:

a shaft part that extends along an axial direction of the pressing roll; and a rotating part that rotates the peeling arm about the shaft part so that the peeling arm lifts the front end of the recording medium up.

5. The fixation device according to claim 4, wherein:

the rotating part includes a cam that is rotated by rotational force of the pressing roll and a contact part that is attached to the peeling arm and makes contact with a cam surface of the cam.

6. An image forming apparatus comprising:

a transfer part that transfers an image onto a recording medium; and the fixation device according to claim 5 that fixes, onto the recording medium, the image transferred onto the recording medium.

7. An image forming apparatus comprising:

a transfer part that transfers an image onto a recording medium; and the fixation device according to claim 4 that fixes, onto the recording medium, the image transferred onto the recording medium.

8. An image forming apparatus comprising:

a transfer part that transfers an image onto a recording medium; and the fixation device according to claim 3 that fixes, onto the recording medium, the image transferred onto the recording medium.

9. The fixation device according to claim 2, further comprising:

a shaft part that extends along an axial direction of the pressing roll; and a rotating part that rotates the peeling arm about the shaft part so that the peeling arm lifts the front end of the recording medium up.

10. The fixation device according to claim 9, wherein:

the rotating part includes a cam that is rotated by rotational force of the pressing roll and a contact part that is attached to the peeling arm and makes contact with a cam surface of the cam.

11. An image forming apparatus comprising:

a transfer part that transfers an image onto a recording medium; and the fixation device according to claim 10 that fixes, onto the recording medium, the image transferred onto the recording medium.

12. An image forming apparatus comprising:

a transfer part that transfers an image onto a recording medium; and the fixation device according to claim 9 that fixes, onto the recording medium, the image transferred onto the recording medium.

13. An image forming apparatus comprising:

a transfer part that transfers an image onto a recording medium; and the fixation device according to claim 2 that fixes, onto the recording medium, the image transferred onto the recording medium.

14. The fixation device according to claim 1, further comprising:

a shaft part that extends along an axial direction of the pressing roll; and a rotating part that rotates the peeling arm about the shaft part so that the peeling arm lifts the front end of the recording medium up.

15. The fixation device according to claim 14, wherein:

the rotating part includes a cam that is rotated by rotational force of the pressing roll and a contact part that is attached to the peeling arm and makes contact with a cam surface of the cam.

16. An image forming apparatus comprising:

a transfer part that transfers an image onto a recording medium; and the fixation device according to claim 15 that fixes, onto the recording medium, the image transferred onto the recording medium.

17. An image forming apparatus comprising:

a transfer part that transfers an image onto a recording medium; and the fixation device according to claim 14 that fixes, onto the recording medium, the image transferred onto the recording medium.

18. An image forming apparatus comprising:

a transfer part that transfers an image onto a recording medium; and the fixation device according to claim 1 that fixes, onto the recording medium, the image transferred onto the recording medium.

19. A fixation device comprising:

a heating roll that heats a transported recording medium whose front end is gripped by a gripping part while rotating;

a pressing roll that is disposed so as to face the heating roll, around which at least a part of the transported recording medium is wound, and presses the wound part of the recording medium toward the heating roll while rotating;

peeling means for peeling the recording medium off from the pressing roll by lifting the front end of the recording medium up in a state where the front end of the recording medium has passed a portion where the pressing roll and the heating roll face each other and is no longer gripped by the gripping part; and reducing means for reducing momentum of the peeling means lifting the front end of the recording medium up.

* * * * *